United States Patent [19]

Smith

[11] Patent Number: 4,825,945

[45] Date of Patent: May 2, 1989

[54] WELLHEAD VALVE

[75] Inventor: Jerry D. Smith, Houston, Tex.

[73] Assignee: Cameron Iron Works USA, Inc., Houston, Tex.

[21] Appl. No.: 170,878

[22] Filed: Mar. 21, 1988

[51] Int. Cl.[4] ..... E21B 34/02

[52] U.S. Cl. ..... 166/86; 137/523; 166/97; 166/325; 251/82

[58] Field of Search ..... 166/85, 86, 87, 97, 166/72; 316, 321–323, 325, 330, 331; 251/82, 83; 137/522, 523

[56] References Cited

U.S. PATENT DOCUMENTS

| | | | |
|---|---|---|---|
| 1,082,232 | 12/1913 | Nielsen | 137/523 |
| 2,919,709 | 1/1960 | Schwegman | 166/325 X |
| 2,939,534 | 6/1960 | Allen | 166/86 |
| 2,958,336 | 11/1960 | Yancey | 166/325 X |
| 3,250,331 | 5/1966 | Boyle | 166/133 |
| 3,574,314 | 4/1971 | Quercia | 137/523 X |
| 3,920,042 | 11/1975 | Blatt | 137/523 |
| 3,954,138 | 5/1976 | Miffre | 166/325 X |
| 4,058,162 | 11/1977 | Smith | 166/124 |
| 4,287,912 | 9/1981 | Hewett | 137/523 X |
| 4,403,628 | 9/1983 | Nijjar | 166/325 X |

OTHER PUBLICATIONS

1978–1979 Composite Catalog of Oil Field Equipment and Services, pp. 1366, 1367.

1982–1983 Composite Catalog of Oil Field Equipment and Services, pp. 1712, 1713.

*Primary Examiner*—Bruce M. Kisliuk

*Attorney, Agent, or Firm*—Vinson & Elkins

[57] ABSTRACT

An improved wellhead valve includes a tubular body with a central passage therethrough and with a downwardly facing valve seat surrounding a portion of said passage, a cylindrical sealing surface above said valve seat, internal threads above said sealing surface and external threads, a valve member positioned within said passage below said valve seat and biased toward engagement with said valve seat, a plug having external threads for engagement with the internal threads of said body and having a sealing means for sealing against said cylindrical sealing surface and a projection extending downwardly from said sealing means, said plug when positioned within said central passage with its sealing means engaging said sealing surface closing flow through said body and said plug being movable downwardly so that its sealing means is below said sealing surface and its projection engages said valve member to move it out of engagement with the valve seat so that flow through said central passage is open and further rotation of said plug provides retrieval of the valve body from within the wellhead housing.

6 Claims, 5 Drawing Sheets

WELLHEAD VALVE

BACKGROUND

The present invention relates to an improved wellhead valve which includes a back pressure valve and which is installed in a wellhead hanger during the removal of the blowout preventer and the installation of the Christmas tree. Prior valves of the type contemplated herein have included a body which can be secured within the hanger, such as by threading it into internal hanger threads, a seal for sealing against the interior of the hanger and a bore through the body with a valve seat facing downwardly and surrounding the lower exit of the bore into a counter-bore. A valve member is mounted within the counterbore and is biased by a spring into seating engagement with the valve seat. Also, any pressure which exists in the well below the valve is exerted against the valve member to cause it to maintain its sealing engagement with the valve seat. Flow is possible through the valve from the interior of the hanger above the valve if sufficient pressure is provided to overcome the spring force and any pressure force urging the valve closed. An example of this type of valve is shown in U.S. Pat. No. 2,939,534 to H. Allen.

Another example of a prior art structure is shown in U.S. Pat. No. 4,058,162 to J. Smith which discloses a plug for sealing within a hanger and is secured therein by the camming action of an internal sleeve which cams the locking elements into an internal groove within the hanger. This structure also includes an internal valve seat and a valve which is adapted to be closed by pressure from below.

The W. Boyle U.S. Pat. No. 3,250,331 discloses a plug for use in a well flow passage and includes a valve seat, a valve member biased to engage the valve seat and close flow from below the plug and a special garter or coil spring lock to engage within a groove in the hanger or other well structure in which the plug is to be positioned.

A two-way check valve is used when the tree above the hanger is to be pressure tested. This valve prevents flow in both directions and allows pressure testing of the tree without having leakage through the valve or having to bias the valve sufficiently to prevent such leakage. Examples of the use of such check valve in place of the back pressure valve is discloses on pages 1366 and 1367 of the 1978–79 Composite Catalog of Oil Field Equipment & Services and on pages 1712 and 1713 of the 1982–83 Composite Catalog of Oil Field Equipment & Services.

As mentioned above there are times when it is desired that the back pressure valve provide a seal against pressure from both directions. One occasion is the decompletion of the well. This occurs when the tree is removed and a blowout preventer installed in its place, thus reversing the normal completion procedures.

SUMMARY

The improved wellhead valve of the present invention includes a tubular body with a central passage therethrough and with a downwardly facing valve seat surrounding a portion of said passage, a cylindrical sealing surface above said valve seat, internal threads above said sealing surface and external threads, a valve member positioned within said passage below said valve seat and biased toward engagement with said valve seat, a plug having external threads for engagement with the internal threads of said body, a sealing means for sealing against said cylindrical sealing surface and a projection extending downwardly from said sealing means, said plug when positioned within said central passage with its sealing means engaging said sealing surface closing flow through said body and said plug being movable downwardly so that its sealing means is below said sealing surface and its projection engages said valve member to move it out of engagement with the valve seat so that flow through said central passage is open.

An object of the present invention is to provide an improved wellhead valve which may be used to close flow through a wellhead hanger during decompletion of the well.

Another object of the present invention is to provide an improved wellhead valve which can be opened during its removal to ensure that there is no pressure build-up below said valve.

Still another object of the present invention is to provide an improved wellhead valve which can be used during the decompletion of a well and includes the back pressure valve and a plug installed to prevent downward flow therethrough and the plug can be used in the recovery of the back pressure valve from the well.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
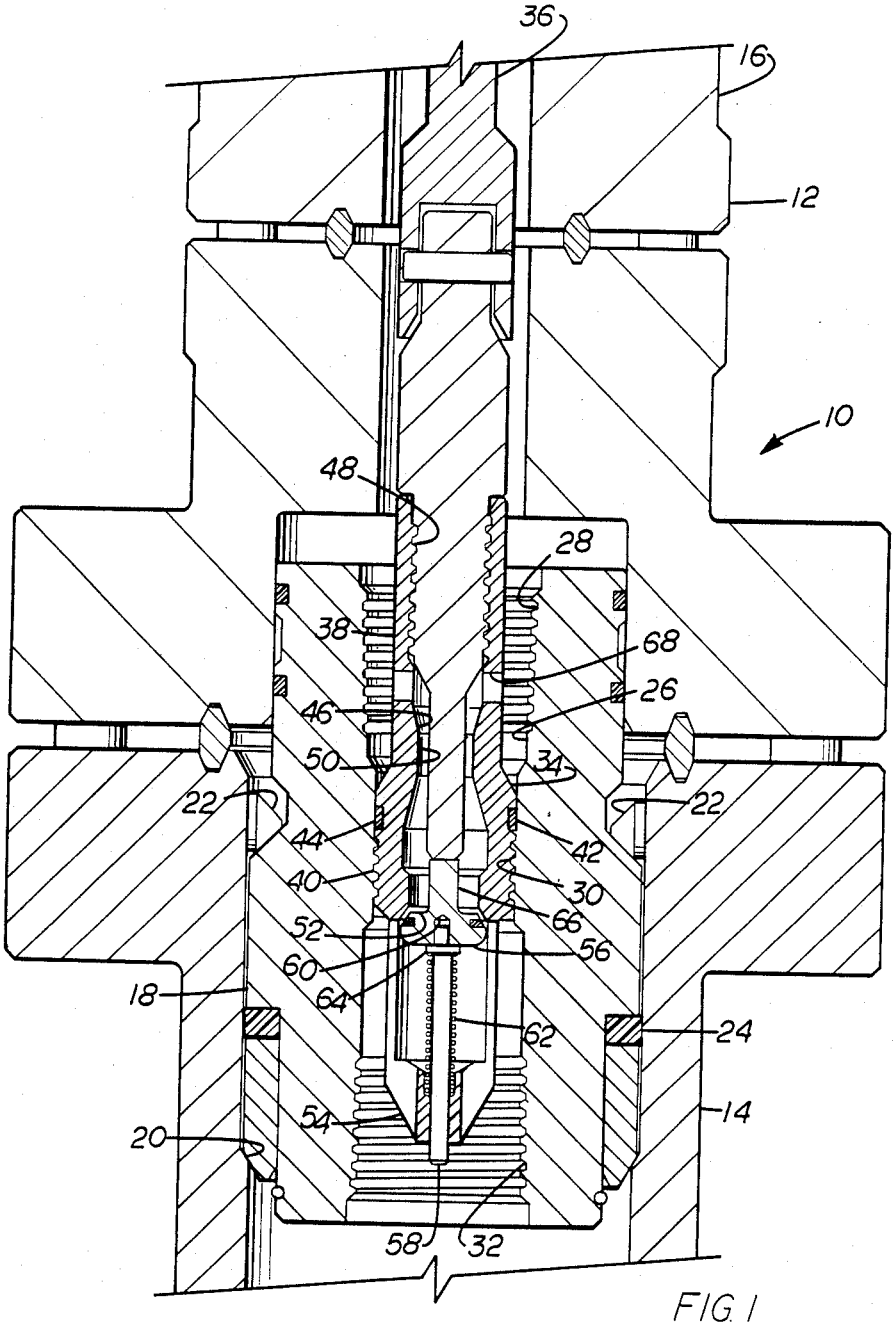
FIG. 1 is a sectional view of a wellhead housing and hanger with the improved wellhead valve being installed therein by the installation tool.

In FIG. 1, wellhead 10 is shown with spool 12 connecting between wellhead housing 14 and tree 16. Hanger 18 is supported within housing 14 on landing shoulder 20 and is held in position by holddown screws 22. As shown suitable sealing means 24 is provided between hanger 18 and the interior of housing 14 above shoulder 20. Hanger 18 includes a central bore 26 extending therethrough with upper internal threads 28, central internal threads 30 and lower internal threads 32. A tubing string (not shown) is suspended from hanger 18 utilizing the threads 32. Central bore 26 of hanger 18 is in communication with the interior of spool 12 and tree 16 and a tubing hanger connected into hanger 18.

Improved wellhead valve 34 of the present invention is shown in FIG. 1 being installed within central bore 26 of hanger 18. It is lowered into tree 16 on tool 36 through a suitable lubricator and through tree 16, spool 12 and landed within hanger 18. Body 38 of wellhead valve 34 includes external threads 40 which are threaded into central internal hanger threads 30. Seal means 42 is carried by body 38 within external groove 44 to provide a seal between the exterior of body 38 and the interior of hanger 18. It is generally preferred that threads 30 in hanger 18 and external threads 40 on valve body 38 be left hand threads so that rotation of body 38 to the right will cause it to thread outwardly in hanger 18.

Body 38 has a central bore 46 extending therethrough with upper internal threads 48 intermediate cylindrical sealing surface 50, downwardly facing valve seat 52 and spider 54 extending into central bore 46 at its lower end. Valve member 56 is positioned within the lower portion of central bore 46 below valve seat 52 and is movable therein to move into and from engagement with valve seat 52. Push rod 58 has its upper end engaged within recess 60 in valve member 56 and extends downwardly therefrom and through the central portion of spider 54. Spring 62 is supported on the upper end of spider 54 and engages collar 64 on push rod 58 so that it provides a biasing force urging valve member 56 toward closing engagement with valve seat 52. During installation tool 36 is threaded into upper internal threads 48 of body 38 and when it is landed tool 36 is removed therefrom by simple rotation. It should be noted that valve member 56 includes upper projection 66 which is engaged by the lower end of tool 36 during installation to maintain valve member 56 out of engagement with valve seat 52. This allows flow upwardly through central bore 46 and out of body 38 through ports 68 which are positioned between upper threads 48 and internal sealing surface 50 as shown.

Figure 2:
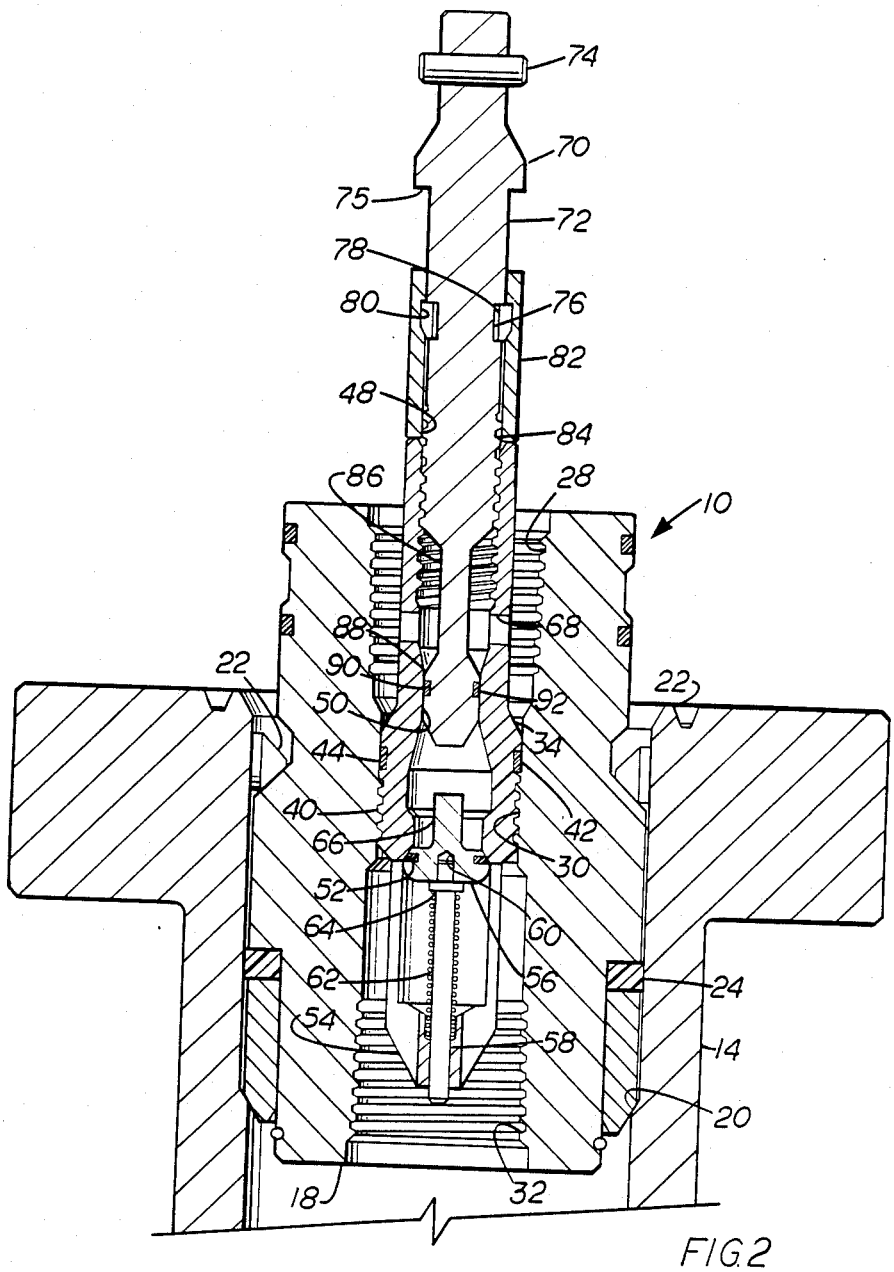
FIG. 2 is sectional view of the improved wellhead valve installed in the wellhead housing and hanger and with its plug installed therein to prevent flow therethrough in both directions during decompletion operations.

With wellhead valve 34 in position and tool 36 and tree 16 removed as shown in FIG. 2, plug 70 threaded into threads 48 within the upper end of valve body 38. Plug 70 includes upper body 72 through which J pin 74 extends for connection to a suitable retrieving tool (not shown), shoulder 75 which faces downwardly, groove 76 with split ring 78 positioned therein and during running also positioned within groove 80 on the interior of sleeve 82, external threads 84 which mate with internal threads 48, neck 86 which has a reduced diameter and enlargement 88 on the lower end of plug 70 which includes seal means 90 in groove 92 around the exterior of enlargement 88. When plug 70 is installed within valve 34 as shown in FIG. 2, valve member 56 has its upper projection 66 spaced below the lower end of plug 70 so it is in engagement with valve seat 52 preventing upward flow through body 38. Also, enlargement 88 of plug 70 is positioned within sealing surface 50 and seal means 90 provides a seal so that flow is prevented from flowing downwardly through body 38. This is the position of the components as shown in FIG. 2.

The installation of plug 70 within valve 34 is relatively simple in that the positioning of seal means 90 in sealing engagement with sealing surface 50 is ensured by the engage of the lower end of sleeve 82 against the upper end of body 38. This creates a resistance to the further movement of plug 70. Plug 70 remains in such sealing position until the resistance to its further downward movement is overcome as hereinafter explained.

Figure 3:
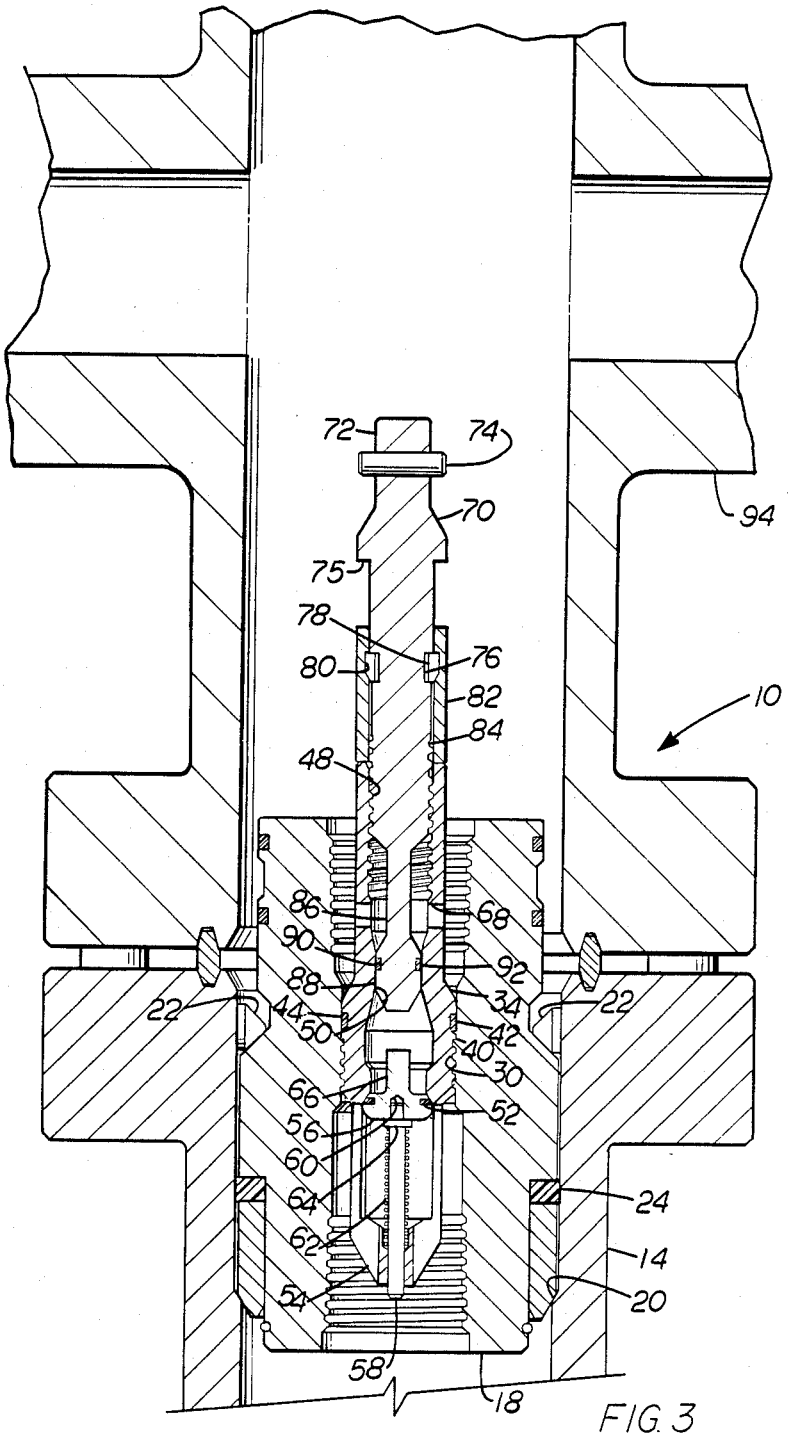
FIG. 3 is another sectional view of the improved wellhead valve with the plug therein after the blowout preventer has been installed on the wellhead housing.
Figure 4:
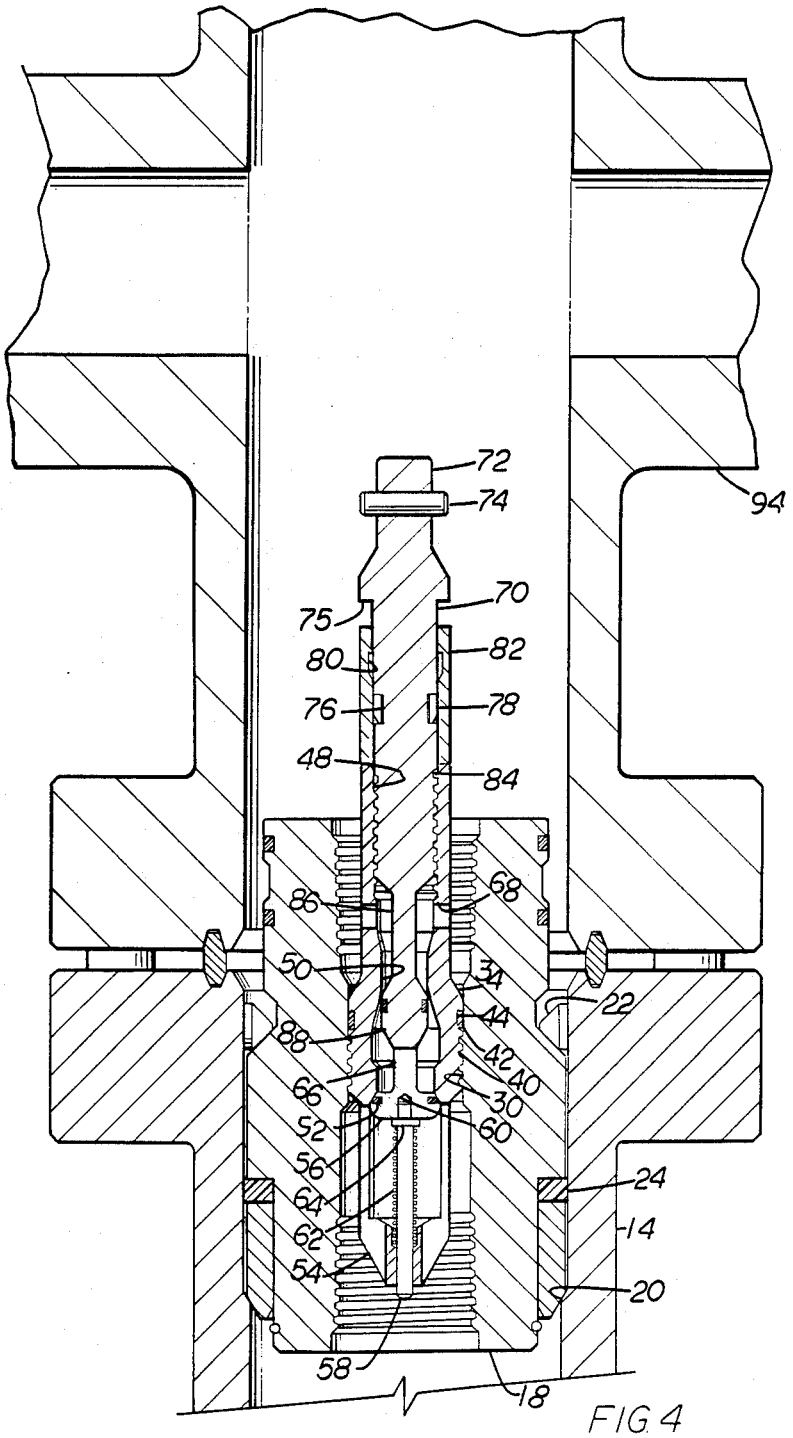
FIG. 4 is another sectional view illustrating the plug in the improved wellhead valve moved to a lower position to the back pressure valve operative.

Blowout preventer 94 is installed on housing 14 as shown in FIG. 3 and pressure tested using seal 90 on enlargement 88 to prevent flow downward through bore 46 of valve body 38. Thereafter plug 70 is threaded further downward into valve body 38 by the overcoming of the resistance to its movement. This movement causes enlargement 88 to pass through sealing surface 50 to the position as shown in FIG. 4. The function of split ring 78 is to releasably secure sleeve 82 to plug 70 until it is desired that plug 70 be moved lower in valve body 38 to prepare for operations in which flow upwardly through valve 36 may be used. Rotation of plug 70 beyond its sealing position within valve body 38 causes sleeve 82 to engage the upper end of body 38 and further rotation causes the tapered surface of the lower end of groove 80 in sleeve 82 to cam split ring 78 into groove 76 in plug 70 allowing further downward movement of plug 70 as it is rotated to the position shown in FIG. 4. Additional rotation causes downward movement of plug 70 so that it engages the upper end of valve member projection 66 and then moves valve member 56 downward out of engagement with valve seat 52. This allows upward flow through the interior of valve body 38 and outward through ports 68 so that pressure below valve 36 can be relieved through valve 36, if desired, or valve member 56 can again be released to engage valve seat 52.

Figure 5:
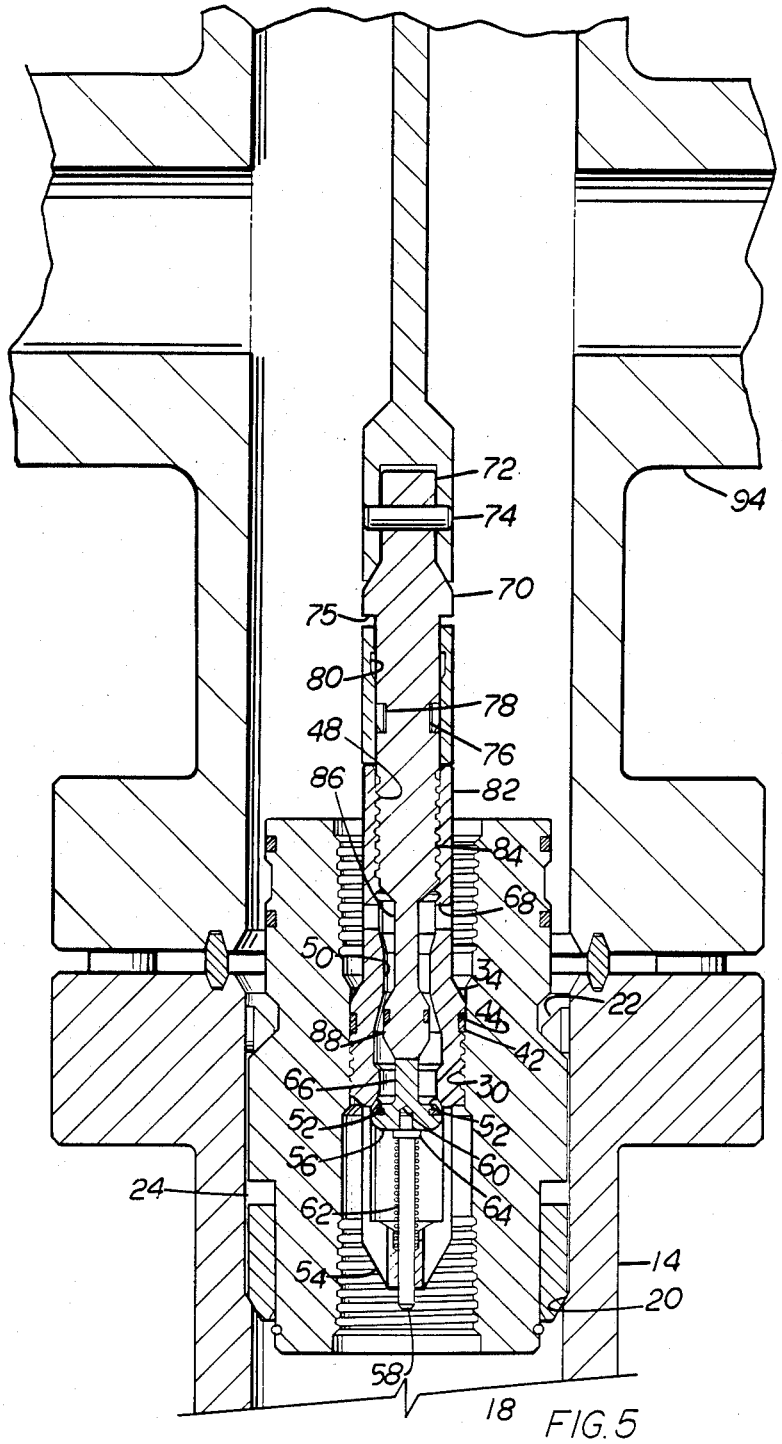
FIG. 5 is another sectional view illustrating the plug lowered within the wellhead valve sufficiently to move the valve member out of engagement with the valve seat.

With the improved wellhead valve of the present invention, it can be removed and retrieved from the hanger by simply rotating plug 70 in the right hand direction. When it has reached the position shown in FIG. 5, valve member 56 will be held below valve seat 52 as explained above and further right hand rotation, because of the left hand threads 30 on the interior of hanger 18 in which valve body 38 is engaged, causes valve body 38 to be rotated out of engagement with threads 30 and then retrieval of plug 70 will retrieve valve member 34 because of its tight threaded engagement therewith.

In the event pressure is discovered below valve 34 upon initial opening of valve member 56 from valve seat 56, it is suggested that rotation be immediately be reversed to close flow through valve seat 56. In this position a decision can be made as to the flow of materials into the well to control the pressure and the valve member 56 should only be opened thereafter when the pressure control plan is ready for implementation.

What is claimed is:

1. A wellhead valve for use within a wellhead comprising a tubular body having a central passage therethrough with a downwardly facing valve seat surrounding a portion of said central passageway, internal threads, external threads and a cylindrical sealing surface above said valve seat, a valve member mounted within said central passage below said valve seat and adapted to move axially therein to close flow through said valve seat, means biasing said valve member into engagement with said valve seat, a plug threaded into said central passage internal threads and having sealing means for sealing against said cylindrical sealing surface in said passage, and a projection extending axially within said passage between said sealing means and said valve member, said plug adapted to be positioned in an upper position within said passage with its sealing means in sealing engagement with said cylindrical sealing surface to prevent flow through said passage, said plug being positionable lower than said upper position in a first lower position in said passage with said sealing means out of sealing engagement with said cylindrical sealing surface to allow said valve member to be operative as a back pressure valve, and said plug being positionable lower than said first lower position in said passage with said sealing means out of sealing engagement with said cylindrical sealing surface and engaging said valve member to hold said valve member out of engagement with its valve seat to allow flow through said passage.

2. A wellhead valve for use within a wellhead comprising a tubular body having a central passage therethrough with a downwardly facing valve seat surrounding a portion of said central passage, internal threads, external threads and a cylindrical sealing surface above said valve seat, a valve member mounted within said central passage below said valve seat and adapted to move axially therein to close flow through said valve seat, means biasing said valve member into engagement with said valve seat, a plug threaded into said central passage internal threads and having sealing means for sealing against said cylindrical sealing surface in said passage, a projection extending axially within said passage between said sealing means and said valve member, said plug adapted to be positioned in an upper position within said passage with its sealing means in sealing engagement with said cylindrical sealing surface to prevent flow through said passage, said plug being positionable lower than said upper position in a first lower position in said passage with said sealing means out of sealing engagement with said cylindrical sealing surface to allow said valve member to be operative as a back pressure valve, and said plug being positionable lower than said first lower position in said passage with said sealing means out of sealing engagement with said cylindrical sealing surface and engaging said valve member to hold said valve member out of engagement with its valve seat to allow flow through said passage, a sleeve surrounding said plug, and releasable connecting means for connecting said sleeve to said plug.

3. A wellhead valve according to claim 2 wherein said releasable connecting means includes an annular groove on the interior of said sleeve having an upper horizontal shoulder and a lower shoulder tapering downwardly and inwardly, an annular groove on the exterior of said plug, and a split ring normally positioned partially within each of said annular grooves to retain said sleeve connected to said plug and having a lower outer tapered surface mating with the lower tapered shoulder of said internal sleeve groove whereby the exertion of sufficient force causes said split ring to be cammed into said plug groove to allow relative movement between said plug and said sleeve.

4. A wellhead valve according to claim 1 including ports extending through said valve body above said cylindrical sealing surface, the lowering of said plug into said valve body to position said plug sealing means below said body allowing flow through said ports and through said valve.

5. A wellhead valve according to claim 4 wherein said projection includes a projection extending from the upper surface of said valve member through said valve seat, said projection extending sufficiently to engage between said valve member and said plug enlargement to push said valve member to its open position as said plug is threaded to its lowest position.

6. A wellhead valve according to claim 5 including engaging means on the upper end of said plug for lowering said plug and causing its rotation within the wellhead housing.

* * * * *